US005197387A

United States Patent [19]

Lacy

[11] Patent Number: 5,197,387

[45] Date of Patent: Mar. 30, 1993

[54] CARD HOLDER JACKET

[76] Inventor: Rodney G. Lacy, 1221 Heatherton Dr., Naperville, Ill. 60563

[21] Appl. No.: 729,991

[22] Filed: Jul. 15, 1991

[51] Int. Cl.[5] ..... B41L 47/02

[52] U.S. Cl. ..... 101/368; 101/474; 40/649

[58] Field of Search ..... 101/368, 369, 407.1, 101/474; 40/649, 651, 653; 269/8

[56] References Cited

U.S. PATENT DOCUMENTS

| | | | |
|---|---|---|---|
| 866,775 | 9/1909 | Choate | 40/651 |
| 1,414,251 | 4/1922 | Börreson | 40/649 |
| 1,650,070 | 11/1927 | Hansman et al. | 40/651 |
| 2,643,605 | 6/1953 | Gollwitzer | 101/369 |
| 2,710,407 | 6/1955 | Hueber et al. | 101/369 |
| 2,810,343 | 10/1957 | Owen | 101/369 |
| 3,379,130 | 4/1968 | Korfmann | 101/368 |
| 3,436,070 | 4/1969 | Utley et al. | 269/8 |
| 4,048,737 | 9/1977 | McDermott | 40/649 |
| 4,356,646 | 11/1982 | Johnson, Jr. | 40/16.4 |
| 4,450,955 | 5/1984 | Featherston | 40/649 |

FOREIGN PATENT DOCUMENTS

| | | | |
|---|---|---|---|
| 05007494 | 11/1954 | Italy | 101/368 |

*Primary Examiner*—Edgar S. Burr
*Assistant Examiner*—Christopher A. Bennett
*Attorney, Agent, or Firm*—Hill, Steadman & Simpson

[57] ABSTRACT

An improved card holder or jacket of the kind adapted for supporting a hospital patient identification card on a printer anvil. The holder comprises a card supporting base panel having along one edge an upstanding flange for guiding the card against sliding displacement from the panel. The panel also has along said one edge a card hold-down and protector for said edge and located in spaced clearance protective adjacent relation to the guide flange. At least the base panel is made of ferromagnetic material for cooperation with magnetic hold-down such as a magnetic strip on the printer anvil.

9 Claims, 1 Drawing Sheet

CARD HOLDER JACKET

BACKGROUND OF THE INVENTION

The present invention relates to a new and improved card holder jacket, and is more particularly concerned with a device of the kind disclosed in U.S. Pat. No. 4,356,646 (incorporated herein by reference), having particular utility for holding hospital patient identification cards carrying vital patient information which is adapted to be transferred to patient records, such as billing papers and other records, in an imprinter equipped to handle card holders of this type.

As discussed in the aforesaid patent, it is preferred that these card holders be made of metal rather than from plastic material as disclosed in U.S. Pat. No. 3,379,130.

The two patents referred to are fairly representative of the present state of the art. Whereas the metal card holder of U.S. Pat. No. 4,356,646 has substantial durability advantages over the plastic card holder of U.S. Pat. No. 3,379,130, widespread use of the metal card holder has revealed a need for safety protection against inexperienced or careless handling of the device in the imprinter or elsewhere.

SUMMARY OF THE PRESENT INVENTION

An important object of the present invention is to provide a new and improved card holder of the kind indicated, which has protective or safety means which will prevent damage to vital card guiding and retaining means of the card holder.

Another object of the invention is to provide new and improved means in a card holder of the character indicated which will facilitate loading of cards into the holder.

A further object of the invention is to provide a new and improved card holder which is not only equipped with damage preventing safety means, but is also equipped to be retained positively in an imprinter.

Still another object of the invention is to provide a new and improved card holder of the character indicated which is inexpensively provided with the improvements aforesaid.

Pursuant to the principles of the present invention, there is provided a new and improved card holder or jacket of the kind adapted for supporting a hospital patient identification card on an imprinter anvil, and comprising a card supporting base panel having along one edge means for guiding the card against sliding displacement from the panel, and the panel also having along the one edge card hold-down means and means for protecting said edge guiding means against damage and located in spaced clearance protective adjacent relation to said guiding means.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
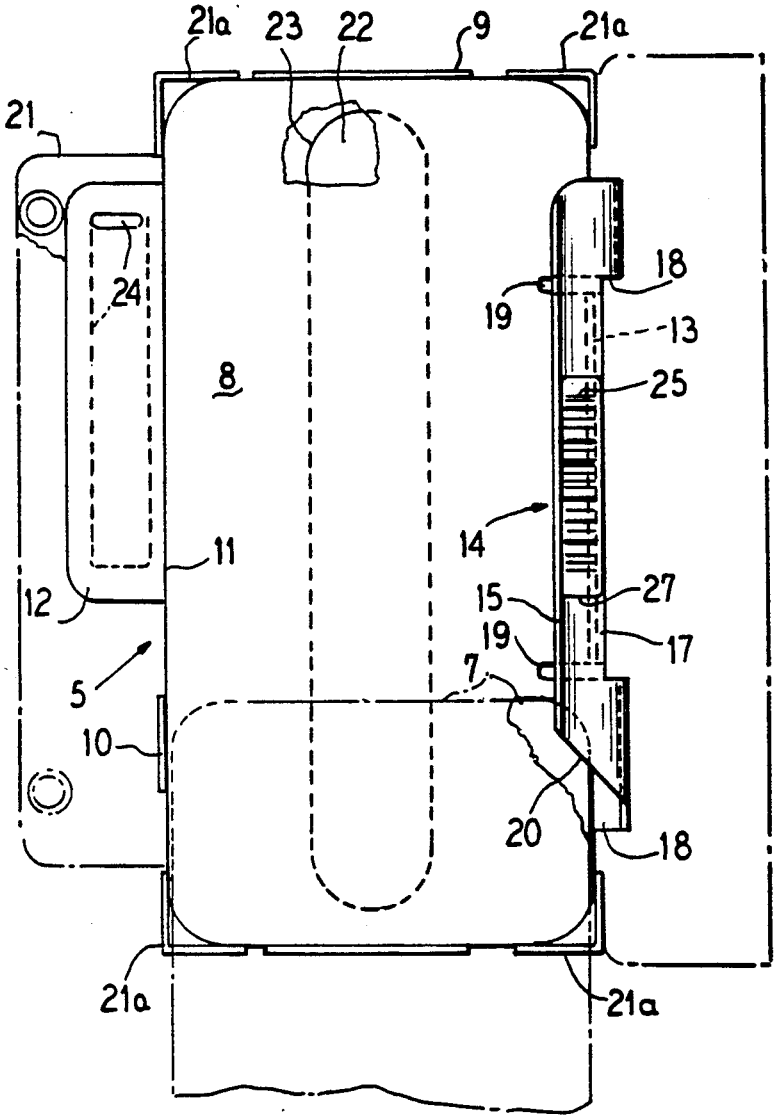
FIG. 1 is a top plan view of a card holder or jacket embodying a best mode example of the present invention.
Figure 2:
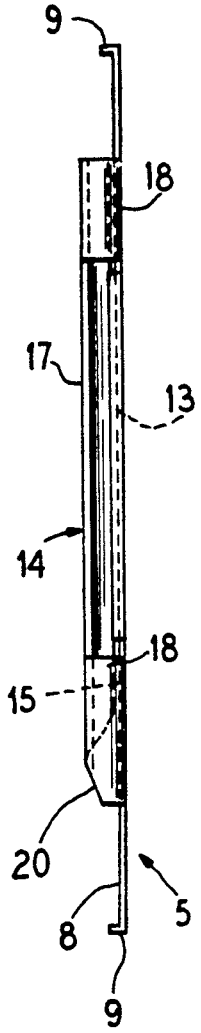
FIG. 2 is a side elevational view looking toward the right-hand edge of the holder as seen in FIG. 1.
Figure 3:
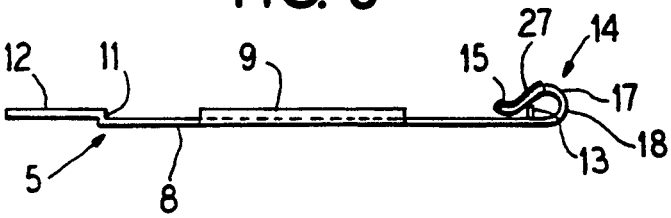
FIG. 3 is an end elevational view looking toward the lower end of the holder as seen in FIG. 1.

As shown in the drawing, a card holder 5 embodying the present invention is adapted for supporting a patient identification card 7 which is preferably made from plastic.

By preference, the card holder 5 is constructed of metal, 0.015 thick, type 430 stainless steel having been found especially satisfactory. The holder 5 comprises an elongated body or base panel 8 of a shape complementary to the identification card 7, and which shape is fairly standard in the hospital industry.

For retaining the card 7 centered on the panel 8, there are provided means, comprising at the opposite ends of the panel preferably identical right angular card edge guide lip flanges 9. Along one of the longitudinal edges of the panel 8 is provided a right angular card edge guide lip flange 10 which is offset endwise from and substantially shorter than a longer right angular card edge guide lip flange 11 portion carrying a laterally projecting indicia-carrying tab 12 desirably in a top plane with the upper edges of the lip flanges 9.

Along the longitudinal edge of the panel 8, which is opposite to the flanges 10 and 11, there is provided means comprising a right angular card edge guide lip flange 13, elongated along this edge and of a common width or height with the guide flanges 9, 10 and 11. All of the guide flanges are of a width or height about the same as the thickness of the card 7. All of the guide flanges cooperate when the card 7 is centered on the base panel 8 to retain the card against skewing or sliding displacement.

For retaining the card 7 against displacement from the, in effect, pocket defined by the flanges 9, 10, 11 and 13, a card anchoring clip 14 is provided which is associated with the flange 13 and formed integrally with, and elongated along the edge of the base panel 8 along which the flange 13 is formed. A smoothly cross-sectionally curved hold-down clamp or lip 15 of the clip 14 is adapted to engage the associated margin of the card 7.

In addition to serving as hold-down means for the card 7, the clip 14 serves as means for protecting the guide flange 13 against damage. To this end, the clip 14 is formed in part generally in the shape of a bead 17, which freely overlies the flange 13, which projects into the radius clearance defined within the bead. To permit the flange 13 and the clip 14 to be formed up integrally with the base panel 8, the bead 17 is of greater length than the flange 13 and has at each end an attachment leg 18 integral with base panel 8 and projecting laterally therefrom sufficiently to offset the bead 17 from the edge of the panel 8 to provide ample clearance along the hold-down lip 15 for operation of the customary printing roller longitudinally along the card 7. As shown, the attachment legs 18 are separated from the adjacent ends of the guide flange 13 by tooling slots 19. The attachment legs 18 and the portions of the bead 17 integrally connected thereto are of sufficient length to provide substantial rigidity to the bead 17 while nevertheless affording some resilience for yieldable card anchoring compression of the hold-down lip 15 which, as formed up, is desirably spaced from the base panel 8 less than the thickness of the card 7.

To facilitate insertion of the card 7 under the hold-down lip 15 when mounting the card on the holder 5, an end of the bead 17 is provided with a slanted lead-in edge 20.

For printing service, the holder 5 is adapted to be mounted on a conventional printing machine anvil 21, having holder-retaining fingers 21*a*, in a position for longitudinal running of a printing roller (not shown) over the card 7 carried by the holder.

A desirable feature for retaining the holder 5 against unintentional displacement from the printer anvil 21, comprises magnetic means 22 carried by the anvil 21 on the area supporting the holder 5. Therefore, by having the holder 5 made from the aforementioned type 430 stainless steel, which is a ferromagnetic steel, the holder 5 is firmly, but releasably held in place on the anvil 21. The magnetic means 22 may conveniently comprise a strip of conventional magnetic tape set into a depression 23 about the same depth as the thickness of the tape so that the exposed surface of the tape will be substantially coplanar with the holder supporting surface of the anvil 21.

From the foregoing, it will be apparent that the present invention provides a new and improved information card holder 5 especially adapted for replaceably supporting information cards 7 such as are widely used in hospitals for providing patient identification and information embossed thereon for roller imprinting transfer onto billing and record sheets. As is customary, in a hospital or like environment, the card 7 will contain vital patient information, and the tab 12 will contain room and possible bed number data 24 embossed thereon. The guide flange 13 is thoroughly protected within the radius of the bead 17 against damage by improper card placement or other careless usage. Placement of the clip 14 is such that it amply clears a printing roller of an imprinter in which the holder may be lodged in use.

In addition to its usefulness as a hold-down clip and guide flange protector, the clip 14 may serve as a convenient carrier of indicia 25 independently or supplemental to the indicia 24 on the tab 12. For this purpose, the indicia 25 may be applied to the exposed surface of the bead 17. Application of the indicia 25 to the bead 17 may be effected in any desirable fashion, such as by tool stamping or by affixing to the bead 17 a card 27 carrying the indicia. The card 27 may be affixed temporarily or permanently by means of adhesive or may be thermally affixed where the card is plastic or supplied with a plastic bonding agent. The indicia 25 may be anything serving the purpose of the user. By way of example, the indicia 25 may be a room number, bar code, or the like, printed or otherwise applied to the carrying medium 27.

It will be apparent that various modifications and/or additions may be made in the apparatus of the invention without departing from the essential feature of novelty involved, which are intended to be defined and secured by the appended claims.

I claim as my invention:

1. A new and improved card holder or jacket of the kind adapted for supporting a hospital patient identification card on a printer anvil, and comprising:

an upwardly facing card supporting base panel on which the card lies in face to face contact, and having on a margin along one edge of the panel upstanding flange means for guiding an edge of the card against sliding displacement toward said edge of the panel, said flange means abutting against said edge of said card; and said panel also having, along said one edge a formation separate and spaced from said flange means and providing a lip overlying said margin and under which lip said edge of the card is received by a simple sliding maneuver for holding said card down on said panel and said formation protecting said flange means against printer imposed damage.

2. A holder according to claim 1, in combination with a printer anvil, said panel comprising ferromagnetic means, and means for magnetically holding the panel removably on the anvil.

3. A holder according to claim 1, formed up from 0.015 thick, type 430 stainless steel so that said panel has ferromagnetic properties.

4. A holder according to claim 3, in combination with a printer anvil having means for cooperation with said panel for magnetically retaining the holder on the anvil.

5. A new and improved card holder or jacket of the kind adapted for supporting a hospital patient identification card in combination with a printer anvil, and comprising:

a card supporting body panel having means for retaining the card against sliding displacement from the panel and including along one edge an upstanding card edge guide;

a card margin overlying retainer means and which retainer means is separated from said edge guide and cooperates with said edge guide protectively;

said panel having magnetic means; and means on said anvil for magnetically holding said panel and thereby retaining said holder against unintentional displacement from the anvil.

6. A combination according to claim 5, wherein said magnetic means on the anvil comprises magnetic tape carried by said anvil under said body panel.

7. A new and improved card holder or jacket of the kind adapted for supporting a hospital patient identification card in combination with a printer anvil, and comprising:

a card supporting base panel having along one edge flange means for guiding an edge of the card against sliding displacement from the panel; and said panel also having, along said one edge means for holding said card down on said panel and for protecting said flange means against printer imposed damage;

said panel comprising ferromagnetic means; and said printer anvil having means for magnetically holding the panel removably on the anvil.

8. A holder according to claim 7, wherein said means for magnetically holding the panel comprises magnetic tape carried by said anvil under said panel.

9. A holder according to claim 7, wherein said panel is formed up from 0.015 thick, type 430 stainless steel.

* * * * *